US007963412B1

(12) United States Patent
Curtiss

(10) Patent No.: US 7,963,412 B1
(45) Date of Patent: Jun. 21, 2011

(54) DRAINAGE APPARATUS FOR A SUMP OF A FLOATING ROOF TANK

(76) Inventor: Russell Curtiss, Houston, TX (US)

( * ) Notice: Subject to any disclaimer, the term of this patent is extended or adjusted under 35 U.S.C. 154(b) by 1186 days.

(21) Appl. No.: 11/623,287

(22) Filed: Jan. 15, 2007

(51) Int. Cl.
*B65D 88/38* (2006.01)

(52) U.S. Cl. ..... 220/219; 220/216

(58) Field of Classification Search ..... 220/216, 220/219

See application file for complete search history.

(56) References Cited

U.S. PATENT DOCUMENTS 1,761,700 A * 6/1930 Bailey ..... 220/219
1,840,587 A * 1/1932 Kimbell ..... 220/219
2,422,322 A * 6/1947 Ulm ..... 220/219
2,643,023 A 6/1953 Moyer
2,717,095 A 9/1955 Gable
3,154,214 A 10/1964 Baker
4,034,887 A 7/1977 Sherlock
4,214,671 A 7/1980 McKibbin et al.
4,248,357 A 2/1981 Stafford
4,790,446 A * 12/1988 Thiltgen ..... 220/219

* cited by examiner

*Primary Examiner* — Anthony Stashick
*Assistant Examiner* — James N Smalley
(74) *Attorney, Agent, or Firm* — Egbert Law Offices PLLC

(57) ABSTRACT

An drainage apparatus for use with the sump of a floating roof tank has a first pipe pivotally connected at one end to an outlet of the sump, a second pipe pivotally connected at one end to an opposite end the first pipe and extending downwardly therefrom, and an outlet pipe pivotally connected to an opposite end of the second pipe. The outlet pipe end extends through the outer wall of the tank. The outlet pipe is offset from the wall of the sump when the roof is positioned adjacent to the floor of the tank. The opposite end of the first pipe is laterally offset from the an end of the second pipe.

4 Claims, 4 Drawing Sheets

DRAINAGE APPARATUS FOR A SUMP OF A FLOATING ROOF TANK

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to tanks with floating roof. More particularly, the present invention relates to sump drainage apparatus whereby a series of pivotally connected pipes allow liquids that are accumulated on the top surface of the floating roof to be drained. Additionally, the present invention relates to sump drainage systems whereby the floating roof can drop to a bottommost position within the tank without interference from the sump drainage system.

2. Description of Related Art Including Information Disclosed Under 37 CFR 1.97 and 37 CFR 1.98.

Floating roof tanks are tanks that have no fixed roof. On these floating roof tanks, any water that collects on the roof, through precipitation falling on the roof, should not be drained into the product stored into the tank. Therefore, drainage systems for floating roofs generally include some type of drain line, such as a pipe or a hose, fluidly connecting a drain point on the floating roof to a drain point outside the tank. The drain line will pass through a wall of the tank. In such systems, the water from the roof usually enters the drain line via a sump located at the center of the floating roof, then drains through the line and exits the tank through a valve located near the bottom of the tank wall.

Floating roof drainage systems have heretofore been of two basic designs. The first design includes a hose drain. In this design, a hose is connected to a sump on the floating roof, runs through the product and then is attached to a penetration in the tank wall just upstream of the drain valve. The hose must be weighted because it is normally dry and self-buoyant. Such hoses are generally made of reinforced rubber-like materials, and are subject to mechanical and chemical abuse from the operation of the tank and/or from the product stored in the tank.

A second design has included pipes interconnected by swing joints. The concept of the second design is to provide a conduit which is much more resistant to mechanical and/or chemical abuse than are the hoses in the first design. However, the swing joint design also has weaknesses. Most importantly, the alignment of such pipes will create a structure within the interior of the tank that can interfere with the movement of the floating roof. As the floating roof drops due to the release of liquids from the interior of the tank, it will eventually encounter obstructions caused by this interconnected pipe system. Since the sump extends downwardly from the bottom surface of the roof for a small distance, the sump will create a obstruction with the underlying piping system and, hence, prevent the floating roof from dropping to its lowest possible point. The dropping of the roof to a low position is important so as to allow for the maximum use of the tank. If it is not possible to withdraw a maximum amount of liquid or fluid from the interior of the tank, then the tank will be at less than its maximum capacity and optimum utilization. As such, it is desirable to allow the floating roof to drop to as low as possible during the descent of the roof caused by the withdraw of liquids and/or fluid from the interior of the tank.

In the past, various patents have issued relating to such drainage systems for sumps of a floating roof tank. For example, U.S. Pat. No. 2,643,023, issued on Jun. 23, 1953 to F. D. Moyer, describes a unique type of sump wherein a structure is placed at the top of the roof so as to drain liquid from the sump. A flexible pipe extends above the floating roof so as to allow the liquid to be drained with a downward movement of the floating roof.

U.S. Pat. No. 2,717,095 issued on Sep. 6, 1955 to M. W. Gable, describes another type of drainage apparatus for a movable roof. This apparatus includes a pair of pipes hingedly connected together. A hose extends along these pipes. One of the pipes is pivotally connected to an underside of the roof. The other pipe is pivotally connected to the floor. Each of the pipes is located directly below the sump of the movable roof. As such, the device tends to block the descent of the roof to its lowest possible position.

U.S. Pat. No. 3,154,214, issued on Oct. 27, 1964 to C. E. Baker, discloses a roof drain for a floating roof tank. A conduit has components that are hingedly connected together. A hose extends along a first pipe which is hingedly connected to a second pipe. Additionally, the hose extends along the second pipe and a third pipe which are hingedly connected together in an accordion fashion. The accordion arrangement of pipes appears to be located below the sump and not offset therefrom. As such, when the roof is in its lowermost position, the structure of the pipes will tend to prevent the roof from descending to its lowest level.

U.S. Pat. No. 4,034,887, issued on Jul. 12, 1977 to W. R. Sherlock, teaches a storage tank with a floating roof and a drainage system. The drainage system includes a flexible conduit extending between the roof and a drain pipe adjacent the base of the tank. The lower end of the conduit is sealed relative to the drain pipe. There is a connection between the upper end of the conduit and the upper surface of the roof so that rainwater accumulating on the roof can pass down the conduit to the drain pipe. This pipe extends along the side of the floating roof.

U.S. Pat. No. 4,214,671, issued on Jul. 29, 1980 to McKibbin et al., discloses a another floating roof drainage system that includes a plurality of pipes. The pipes are connected to each other to form a completely welded system and are suspended from the bottom of the floating roof. The pipes will pivot with respect to one another so as to move as the roof moves.

U.S. Pat. No. 4,248,357, issued on Feb. 3, 1981 to D. C. Stafford, provides another type of drain that includes a flexible coiled hose having a lower outlet end in communication with a conduit inlet in a lower portion of the tank. The drain has an upper inlet end in communication with a sump space on the floating roof deck. The coiled hose is extensible in length for a distance at least equal to the height that the floating roof is vertically displaceable in the tank whether it is full or empty of liquid.

FIG. 1 generally illustrates the problems associated with the prior art piping system for use with the sump 10 of a floating roof 12. As can be seen, a first pipe 14 is hingedly connected at pivot 16 to a second pipe 20. An outlet pipe 22 is hingedly connected to an opposite end of the second pipe 20 from the pivot 16 with the first pipe 14. The outlet pipe 22 will extends so as to emerge outwardly of the wall 24 of the tank 26. It can be seen that when the sump 10 reaches its lowermost position, the structure of the outlet pipe 22 and/or the hinge connection 28 between the outlet pipe 22 and the second pipe 20 will block the downward movement of the floating roof 12 to its lower position. As such, it is not possible to drain any liquids in the tank 26 that would reside below the bottom surface of the floating roof 12 and the top surface of the bottom 30 of tank 26. It is an object of the present invention to provide a drainage system for the sump of a floating roof tank which allows the floating roof to drop to its lowermost position within the tank without obstruction.

It is another object of the present invention to provide a drainage apparatus for use with a sump of the floating roof tank that is of a configuration that can be easily introduced through the manhole of the tank.

It is a further object of the present invention to provide a drainage apparatus for use with a sump of a floating roof tank which is easy to install, easy to use and relatively inexpensive.

These and other objects and advantages of the present invention will become apparent from a reading of the attached specification and appended claims.

BRIEF SUMMARY OF THE INVENTION

The present invention is an apparatus that comprises a tank having an outer wall and a floor, a roof movably positioned in the tank relative to a level of fluid in the tank, a sump affixed to the bottom surface of the roof so as to have an outlet formed through a wall thereof, a first pipe pivotally connected at one end to the outlet of the sump, a second pipe pivotally connected at one end to an opposite end the first pipe and extending downwardly therefrom, and an outlet pipe pivotally connected to an opposite end of the second pipe. The outlet pipe extends through adjacent outer wall of the tank. The outlet pipe is offset from the wall of the sump when the roof is positioned adjacent the floor of the tank.

In the present invention, the opposite end of the first pipe is laterally offset from the one end of the second pipe. A hose is connected to the opposite end of the first pipe and to the end of the second pipe. A pivot frame is affixed to the opposite end of the first pipe and to the end of the second pipe. The hose is received by the pivot frame. The pivot frame has a yoke formed thereon at one side of the first and second pipes. A support rod is pivotally connected at one end to the yoke. The support rod has second pipe pivotally connected to the floor of the tank. The floor of the tank has a yoke affixed thereto. The opposite end of the support rod is pivotally connected to the yoke. The hose has a curved portion between the ends of the first and second pipes. This curved portion extends outwardly of the pivot bracket.

In the preferred embodiment of the present invention, outlet pipe includes a first pipe section having an end pivotally connected to the second pipe generally adjacent the floor of the tank, an outlet pipe section extending through the wall of the tank, and a 90° elbow connecting the first pipe section and the outlet pipe section. The first pipe section extends adjacent to the wall of the sump when the roof is adjacent the floor. The second pipe is aligned with the first pipe section. A yoke is affixed to the floor of the tank. A pivot frame is pivotally connected to the yoke. A hose is connected to the end of the first pipe section and to the opposite end of the second pipe section.

In an alternative embodiment of the present invention, the outlet pipe includes a first pipe section having an end pivotally connected to the second pipe generally adjacent the floor of the tank, an outlet pipe section extending through the wall of the tank, and a 90° elbow connecting the first pipe section and the outlet pipe section. The first pipe section extends along a side of the second pipe when the sump is adjacent the floor. The outlet pipe is positioned away from the sump when the sump is adjacent to the floor of the tank.

In the present invention, a pivot frame is connected to the outlet of the sump and to one end of the first pipe. A hose is connected to the sump and to the end of the first pipe.

DETAILED DESCRIPTION OF THE INVENTION

Figure 1:
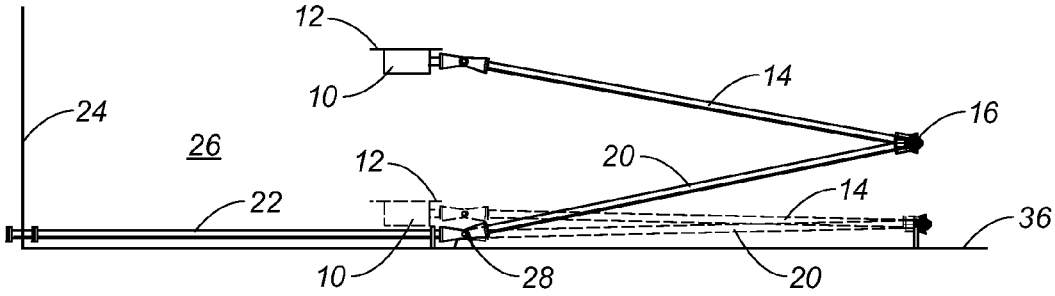
FIG. 1 Prior Art
FIG. 1 is a side elevational view showing a prior art sump drainage system.
Figure 2:
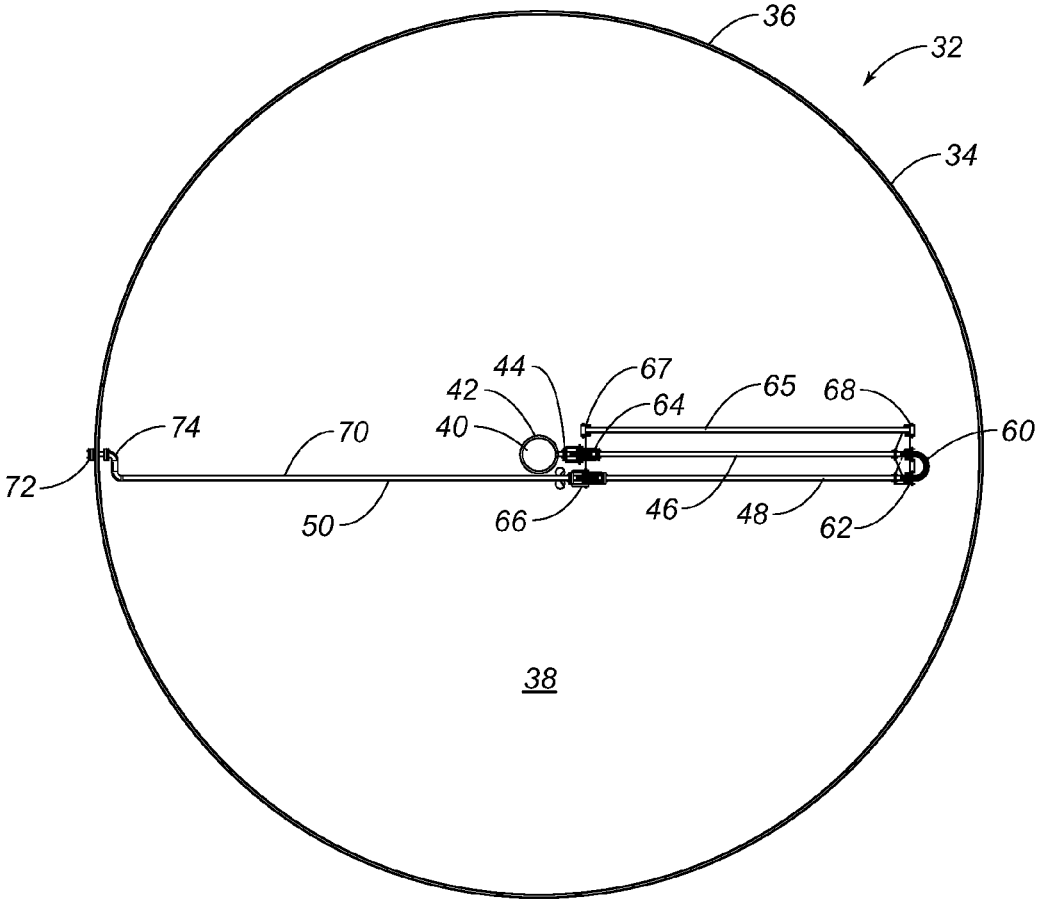
FIG. 2 is a plan view with a partially transparent roof showing the drainage apparatus of the present invention.

Referring to FIG. 2, there is shown the drainage apparatus 32 in accordance with the preferred embodiment of the present invention. The drainage apparatus 32 includes a tank 34 having an outer wall 36. A floating roof 38 will extend across the interior of the tank 34 so as to form a surface overlying the top level of the liquid within the tank 34. A sump 40 is formed generally centrally of the floating roof 38. The floating roof 38 is illustrated in transparent fashion in FIG. 2 for the purposes of illustration. The sump 40 has a generally cylindrical shape with an outer wall 42. The roof 38 is movably positioned within the tank 34 relative to the level of liquid within the tank 34. The sump 40 is affixed to the bottom surface of the roof 38. The sump 40 has an outlet 44 formed through the wall 42 thereof. A first pipe 46 is pivotally connected at one end to the outlet 44 of the sump 40. A second pipe 48 is pivotally connected at one end to an opposite end of the first pipe 46. An outlet pipe 50 is pivotally connected to an opposite end of the second pipe 48. The outlet pipe 50 will have an end extending outwardly through the outer wall 36 of the tank 34. As can be seen, the outlet pipe 50 will extend adjacent to the side wall 42 of the sump 40 so as to avoid any blocking of the movement of the floating roof 38 to its lowermost position.

Figure 4:
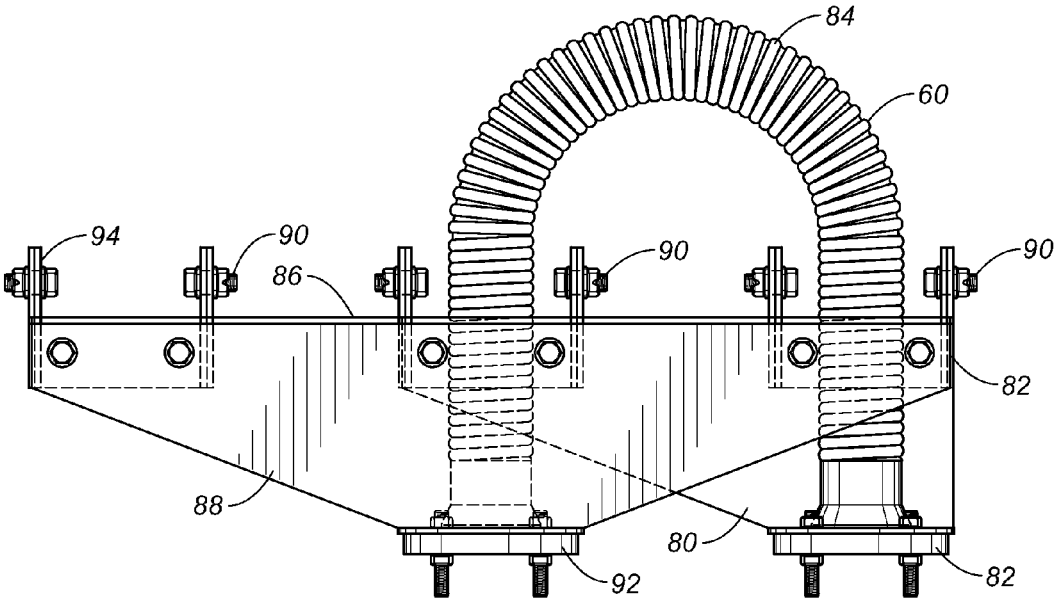
FIG. 4 is a plan view showing the connection between the ends of the first pipe and the second pipe on the pivot frame of the drainage apparatus of the present invention.
Figure 5:
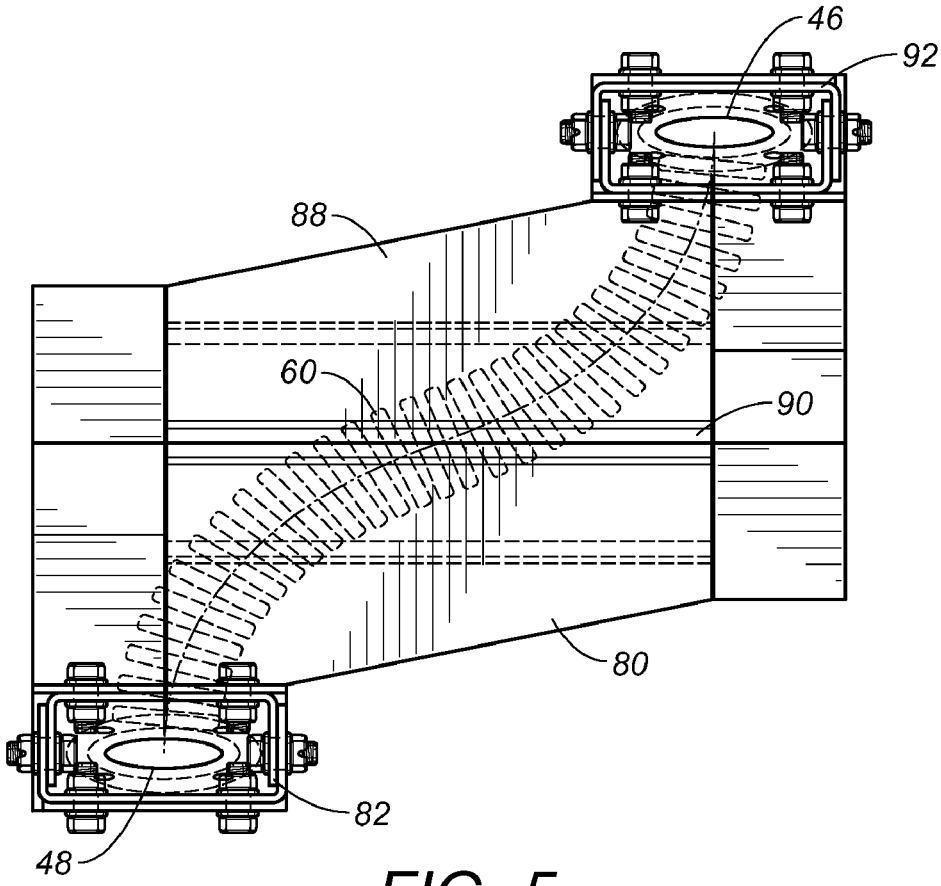
FIG. 5 is a frontal view of the pivot frame as used with the first and second pipes of the drainage apparatus of the present invention.

As can be seen in FIG. 2, a hose 60 is connected to the end of the first pipe 46 opposite the outlet 44 and to the end of the second pipe 48 opposite the pivotal connection of the outlet pipe 50. A pivot bracket 62 will support the ends of the pipes 46 and 48 and will also receive the hose 60. A more detailed description of this pivot bracket 62 is illustrated in FIGS. 4 and 5 herein. A pivot mechanism 64 serves to connect the end of the first pipe 46 with the outlet 44 of the sump 40. Similarly, a pivot bracket 66 serves to connect the outlet pipe 50 with the second pipe 48. Each of the pivot brackets 64 and 66 have a configuration similar to that illustrated in FIG. 6 herein.

A support rod 65 has a first end 67 pivotally connected to a yoke affixed to the floor of the tank 34. The support rod 66 has a second end 68 that is pivotally received within the pivot bracket 62. As such, the support rod 65 supports the proper movement of the pipes 46 and 48 upwardly and downwardly within the tank 34 and avoids any twisting or deflection by this movement. The parallelogram created by the arrangement of the second pipe 48 and the support rod 66 produces strong structural forces to maintain the proper alignment of the first pipe 46 with the outlet 44 of the sump 40 and with the pivot bracket 62.

The outlet pipe 50 includes a first pipe section 70 that has an end pivotally connected to the second pipe 48 generally adjacent to the floor of the tank 34. An outlet pipe section 72 extends through the wall 36 of the tank 34. A 90° elbow 74 connects the outlet pipe section 72 with the first pipe section 70. As such, it can be seen that the use of this 90° elbow effectively offsets the first pipe section 70 of the outlet pipe 50 so that it resides outside of wall 42 of the sump 40 when the floating roof 38 is in its lowermost position.

Figure 3:
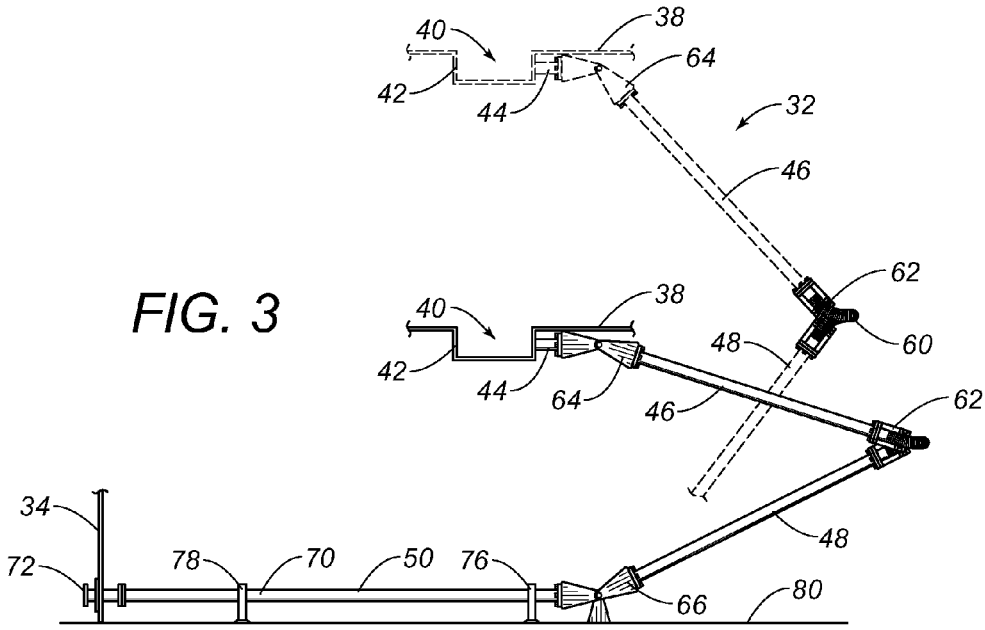
FIG. 3 is a side elevational view showing the operation of the drainage apparatus of the present invention.

FIG. 3 illustrates the operation of the drainage apparatus 32 of the present invention. As can be seen in broken line fashion, the floating roof 38 is in an uppermost position. The sump 40 will extend downwardly from the bottom surface of the floating roof 38. The outlet pipe 44 extends through the wall 42 of the sump 40 so as to connect with the pivotable pivot bracket 64 and to one end of the pipe 46. First pipe 46 will extend to the pivot bracket 62. The hose 60 connects the opposite end of the first pipe 46 with an end of the second pipe 48. In solid line fashion, it can be seen that the floating roof 38, along with the sump 40, have lowered within the interior of the tank 34. The pivot bracket 64 will bring the first pipe 46 closer to linear alignment with the outlet pipe 44. Similarly, the angle will be rather sharp between the first pipe 46 and the second pipe 48 as caused by the pivot bracket 62. Similarly, the bracket 66 connecting the second pipe 48 with the outlet pipe 50 will tend to become more linear. Supports 76 and 78 serve to maintain the first pipe section 70 of the outlet pipe 50 a small distance above the floor 80 of the tank 34. Through the arrangement of the present invention, regardless of the position of the sump 40, any liquids accumulated within sump 40 will pass through the outlet pipe 44, through the first pipe 46, through the second pipe 48 and outwardly of the tank 34 through the outlet pipe 50. Because of the offset relationship between the outlet pipe 50 and the outer wall 42 of the sump 40, the sump 40 can drop to a lowermost position adjacent to the bottom 80 of the tank 34.

FIG. 4 is illustrative of the construction of the pivot bracket 62 of the present invention. A bottom plate assembly 80 has a connector 82 suitable for connection to the second pipe 48. Hose 60 has an end joined to the second pipe 48 and supported upon the top surface of the bottom plate assembly 82. The hose 60 will be supported thereon so as to have a curved portion 84 extending beyond the back 86 of the pivot bracket assembly 62. There is a top plate assembly 88 which will reside over the bottom plate assembly 82 and suitably pivot about pivot axis 90 relative to the bottom plate assembly 80. A connector 92 serves to join the opposite end of the hose 60 with the first pipe 46. A surface of the hose 60 will reside over the top surface of the top plate assembly 88. A yoke 94 is provided to a side of the hose 60. Yoke 94 is configured for attachment to the end of the support rod 65. Through the arrangement of the support rod 66 and the second pipe 48, the first pipe 46, as connected to connector 92, is centralized therebetween. As such, the proper orientation of the first pipe 46 will be maintained throughout the motion of the floating roof.

FIG. 5 illustrates the top plate assembly 88 as pivoted outwardly relative to the bottom plate assembly 80. The connector 92 is located at a higher level than the connector 82. The hose 60 illustrated in broken line fashion will extend in a snaking manner between the connectors 82 and 92. As such, through this connector arrangement, the second pipe 48 (as connected to connector 82) is laterally offset from the first pipe 46 (as connected to connector 92).

Figure 6:
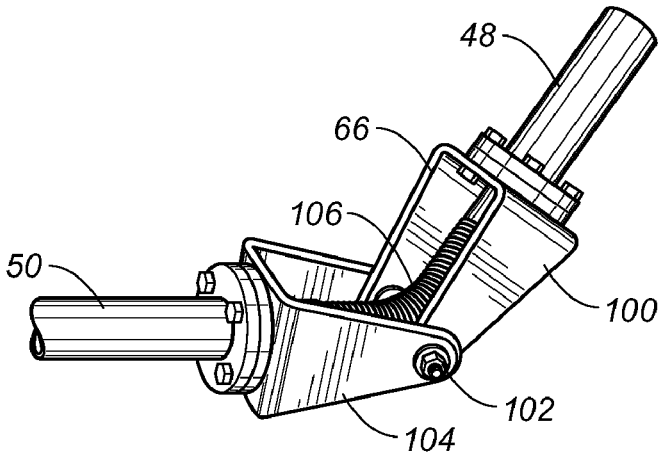
FIG. 6 is a perspective view showing the pivot frame associated with the connection between the outlet pipe and the second pipe of the drainage apparatus of the present invention.

FIG. 6 illustrates the pivotal connector 66 as extending between the outlet pipe 50 and the second pipe 48. The pivot connection 66 is of a type manufactured by Pivot Master, Inc., of Houston, Tex. As can be seen, there is a first bracket 100 that is connected by pin connection 102 to a second bracket 104. A hose 106 will connect the respective ends of the pipes 48 and 50 together. As such, relative movement between the pipes 48 and 50 will cause a flexing of the hose 106 while still allowing the liquid to pass therethrough. The configuration of the brackets 100 and 104 will tend to prevent deflection between the linear alignment of the pipes 48 and 50.

Figure 7:
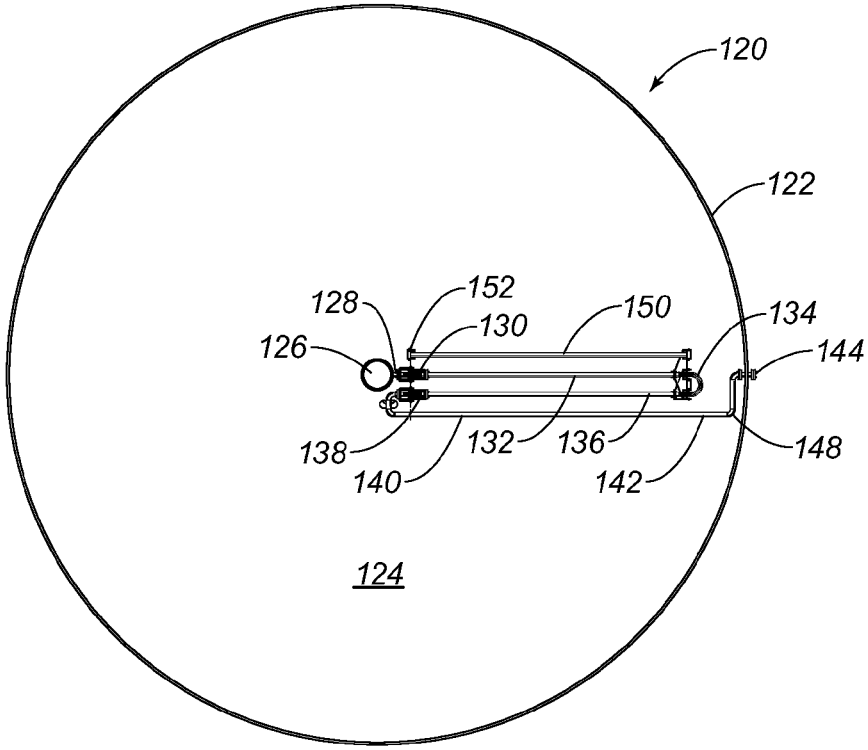
FIG. 7 is a plan view showing a first alternative embodiment of the drainage apparatus of the present invention.

FIG. 7 shows an alternative embodiment of the drainage apparatus 120 of the present invention. The drainage apparatus 120 includes a tank 122 having a floating roof 124 (illustrated transparently) therein. A sump 126 is formed centrally of the floating roof 124. The sump 126 has an outlet 128 that is pivotally connected by a pivot mechanism 130 to a first pipe 132. The pipe 132 has an opposite end connected by pivot mechanism 134 to an end of a second pipe 136. The second pipe 136 is connected by a pivot mechanism 138 to the outlet pipe 140. The outlet pipe 140 includes a first pipe section 142 that extends in generally parallel relationship to the first pipe 132 and the second pipe 136. There is an outlet pipe section 144 which extends outwardly through the wall 146 of the tank 122. A 90° elbow 148 connects the outlet pipe section 144 to the first pipe section 142. The pivot mechanisms 130 and 138 have a configuration similar to that of the pivot mechanism illustrated herein in FIG. 6. The pivot bracket 134 has a construction similar to that of the pivot brackets illustrated in FIGS. 4 and 5 herein. As can be seen, the drainage apparatus 120, as illustrated in FIG. 7, has piping that is completely offset from the space around the sump 126. As such, through this structure, there will be no obstruction to the downward movement of the sump 126 toward the bottom of the tank 122. A support rod 150 is also connected to the pivot bracket 134 at one end and to a yoke 152 mounted on the floor of the tank 122. Once again, this arrangement of the support rod 150 in combination with the second pipe 136 creates a parallelogram which maintains the first pipe 132 in proper orientation with the sump 126.

Figure 8:
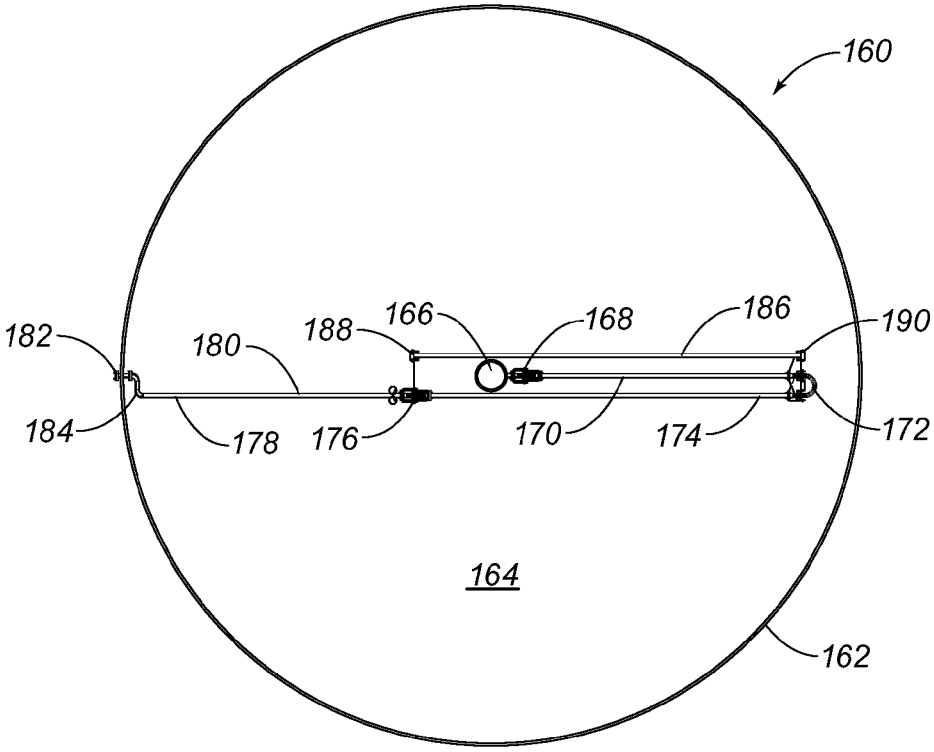
FIG. 8 is a plan view showing a second alternative embodiment of the drainage apparatus of the present invention.

FIG. 8 shows a third alternative embodiment of the drainage apparatus 160 of the present invention. In FIG. 8, it can be seen that the tank 162 has a floating roof 164 (illustrated transparently) received therein. A sump 166 is formed centrally of the floating roof 164. The outlet of the sump 166 is connected by pivot mechanism 168 to a first pipe 170. The first pipe 170 is connected by pivot bracket 172 to the second pipe 174. The second pipe 174 is connected by a pivot bracket 176 to the outlet pipe 178. Outlet pipe 178 includes a first pipe section 180, an outlet pipe section 182 and a 90° elbow 184. The support rod 186 extends in parallel relationship to the first pipe 170 and to the second pipe 174. The support rod, in the drainage apparatus 160, is rather elongated so as to have an end 188 pivotally connected to a yoke on the floor of the tank 162. The support rod 180 will extend along one side of the wall of the sump 166 while the second pipe 174 extends adjacent to the opposite side of the sump 166. As such, neither the support rod 186 or the second pipe 174 creates an obstruction to the downward movement of the sump 166. The pivot brackets 168 and 176 will have a configuration similar to that illustrated in FIG. 6. The pivot bracket 172 will have construction similar to that shown in FIGS. 4 and 5. The end 190 of the support rod 186 is pivotally connected to the pivot bracket 172.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a tank having an outer wall and a floor;

a roof movably positioned in said tank relative to a level of fluid in said tank, said roof having a top surface and a bottom surface;

a sump affixed to said bottom surface of said roof, said sump having an outlet formed through a side wall thereof, said sump having a bottom extending in a horizontal plane below said outlet;

a first pipe pivotally connected at one end to said outlet of said sump;

a second pipe pivotally connected at one end to an opposite end said first pipe and extending downwardly therefrom; and an outlet pipe pivotally connected to an opposite end of said second pipe, said outlet pipe extending through said outer wall of said tank, said outlet pipe being to a side of said side wall of said sump when said roof is positioned adjacent said floor of said tank, said outlet pipe being in a horizontal plane above said horizontal plane in which said bottom of said sump extends when said roof is positioned adjacent said floor of said tank, said opposite end of said first pipe being laterally offset from a vertical axis normal to said roof from said one end of said pipe;

a hose connected to said opposite end of said first pipe and to said one end of said second pipe;

a pivot frame affixed to said opposite end of said first pipe and to said one end of said second pipe, said hose received by said pivot frame, said pivot frame having a yoke formed thereon at one side of said first and second pipes; and a support rod pivotally connected at one end to said yoke, said support rod having an opposite end pivotally connected to said floor of said tank.

2. The apparatus of claim 1, said floor of said tank having a yoke affixed thereto, said opposite end of said support rod pivotally connected to said yoke on said floor of said tank.

3. An apparatus comprising:

a tank having an outer wall and a floor;

a roof movably positioned in said tank relative to a level of fluid in said tank, said roof having a top surface and a bottom surface;

a sump affixed to said bottom surface of said roof, said sump having an outlet formed through a side wall thereof, said sump having a bottom extending in a horizontal plane below said outlet;

a first pipe pivotally connected at one end to said outlet of said sump;

a second pipe pivotally connected at one end to an opposite end said first pipe and extending downwardly therefrom; and an outlet pipe pivotally connected to an opposite end of said second pipe, said outlet pipe extending through said outer wall of said tank, said outlet pipe being to a side of said side wall of said sump when said roof is positioned adjacent said floor of said tank, said outlet pipe being in a horizontal plane above said horizontal plane in which said bottom of said sump extends when said roof is positioned adjacent said floor of said tank, said opposite end of said first pipe being laterally offset from a vertical axis normal to said roof from said one end of said pipe;

a hose connected to said opposite end of said first pipe and to said one end of said second pipe;

a pivot frame affixed to said opposite end of said first pipe and to said one end of said second pipe, said hose received by said pivot frame, said hose having a curved portion between said opposite end of said first pipe and said one end of said second pipe, said curved portion extending outwardly of said pivot frame.

4. An apparatus comprising:

a tank having an outer wall and a floor;

a roof movably positioned in said tank relative to a level of fluid in said tank, said roof having a top surface and a bottom surface;

a sump affixed to said bottom surface of said roof, said sump having an outlet formed through a wall thereof;

a first pipe pivotally connected at one end to said outlet of said sump;

a second pipe pivotally connected at one end to an opposite end said first pipe and extending downwardly therefrom;

an outlet pipe pivotally connected to an opposite end of said second pipe, said outlet pipe end extending through said outer wall of said tank, said opposite end of said first pipe being laterally offset from said one end of said second pipe;

a hose connected to said opposite end of said first pipe and to said one end of said second pipe;

a pivot frame affixed to said opposite end of said first pipe and to said one end of said second pipe, said hose received by said pivot frame, said pivot frame having a yoke formed thereon at one side of said first and second pipes; and a support rod pivotally connected at one end to said yoke, said support rod having an opposite end pivotally connected to the floor of the tank.

* * * * *